US007825860B2

(12) United States Patent
Ying

(10) Patent No.: US 7,825,860 B2
(45) Date of Patent: Nov. 2, 2010

(54) ANTENNA ASSEMBLY

(75) Inventor: Zhinong Ying, Lund (SE)

(73) Assignee: Sony Ericsson Mobile Communications AB, Lund (SE)

( * ) Notice: Subject to any disclaimer, the term of this patent is extended or adjusted under 35 U.S.C. 154(b) by 212 days.

(21) Appl. No.: 12/104,013

(22) Filed: Apr. 16, 2008

(65) Prior Publication Data

US 2009/0262022 A1 Oct. 22, 2009

(51) Int. Cl.
*H01Q 1/38* (2006.01)
*H01Q 1/24* (2006.01)

(52) U.S. Cl. ..... 343/700 MS; 343/702

(58) Field of Classification Search ..... 343/700 MS, 343/702, 895
See application file for complete search history.

(56) References Cited

U.S. PATENT DOCUMENTS

| | | | | |
|---|---|---|---|---|
| 6,304,220 | B1 * | 10/2001 | Herve et al. | 343/700 MS |
| 7,023,385 | B2 * | 4/2006 | Harihara | 343/700 MS |
| 7,405,697 | B2 | 7/2008 | Ying | |
| 7,466,277 | B2 * | 12/2008 | Ishizuka et al. | 343/702 |
| 2003/0001785 | A1 | 1/2003 | Park | |
| 2005/0231428 | A1 | 10/2005 | Iguchi et al. | |
| 2005/0243001 | A1 | 11/2005 | Miyata et al. | |
| 2007/0109203 | A1 * | 5/2007 | Park et al. | 343/702 |
| 2008/0062045 | A1 | 3/2008 | Dinallo et al. | |

FOREIGN PATENT DOCUMENTS

| | | | |
|---|---|---|---|
| EP | 1 460 713 | A1 | 9/2004 |
| EP | 1 505 689 | A1 | 2/2005 |
| EP | 1 569 300 | A1 | 8/2005 |
| WO | WO 02/078123 | A1 | 10/2002 |
| WO | WO 2005/101571 | A1 | 10/2005 |
| WO | WO 2007/122870 | | 11/2007 |
| WO | WO 2008/030852 | | 3/2008 |

OTHER PUBLICATIONS

Co-pending U.S. Appl. No. 12/104,208, filed Apr. 16, 2008, entitled "Antenna Assembly, Printed Wiring Board and Device," Zhinong Ying et al.

International Search Report and Written Opinion issued in corresponding international application No. PCT/EP2008/063335, mailed Dec. 4, 2008, 13 pages.

* cited by examiner

*Primary Examiner*—Hoang V Nguyen
(74) *Attorney, Agent, or Firm*—Harrity & Harrity, LLP

(57) ABSTRACT

An antenna assembly may include a printed wiring board (PWB) and a dielectric substrate including a first antenna pattern, the dielectric substrate being configured to be mounted on the PWB. The antenna assembly may include a second antenna pattern that may be configured to be used as a radiating element of an FM Tx antenna or a Near Field Communication (NFC) antenna. The second antenna pattern may be provided a) on/in the dielectric substrate, or b) on the PWB at the interface between the dielectric substrate and the PWB, or c) partly on a surface of the dielectric substrate and partly on a surface of said PWB.

19 Claims, 2 Drawing Sheets

ANTENNA ASSEMBLY

TECHNICAL FIELD

The present invention generally relates to an antenna assembly and, more particularly, to a dielectric block, a printed wiring board (PWB), and a device implementing such an antenna assembly and/or dielectric block and/or PWB.

BACKGROUND

An antenna may include a transducer (e.g., transceiver) designed to transmit and/or receive radio, television, microwave, telephone and radar signals, i.e., an antenna converts electrical currents of a particular frequency into electromagnetic waves and vice versa. Physically, an antenna is an arrangement of one or more electrical conductors that is configured to generate a radiating electromagnetic field in response to an applied alternating voltage and the associated alternating electric current, or that can be placed in an electromagnetic field so that the field will induce an alternating current in the antenna and a voltage between its terminals.

Portable wireless communication electronic devices, such as mobile phones, typically include an antenna that is connected to electrically conducting tracks or contacts on a printed wiring board (PWB) by soldering or welding. Manufacturers of such electronic devices are under commercial pressure to increasingly reduce the relative physical size, weight, and cost of the devices and improve their electrical performance.

To minimize the size of an antenna for a given wavelength, a microstrip antenna (also known as a printed antenna) may be used inside a portable wireless communication electronic device. A microstrip antenna can be fabricated by etching an antenna pattern (i.e., a resonant wiring structure) on one surface of an insulating dielectric substrate having a dielectric constant ($\in_r$) greater than 1, with a continuous conducting layer, such as a metal layer, bonded to the opposite surface of the dielectric substrate that forms a ground plane. Such an antenna can have a low profile, be mechanically rugged, and relatively inexpensive to manufacture and design because of its incomplex two-dimensional geometry.

One of the most commonly employed microstrip antennas is a rectangular patch. The rectangular patch antenna is approximately a half wavelength long section of rectangular microstrip transmission line. When air is the antenna substrate, the length of the rectangular microstrip antenna is approximately half of a free-space wavelength. As the antenna is loaded with a dielectric as its substrate, the length of the antenna decreases as the relative dielectric constant of the substrate increases. That is, the wavelength of the radiation in the dielectric is shortened by a factor of $1/\sqrt{\in_r}$. An antenna including such a dielectric substrate may therefore be made shorter by a factor of $1/\sqrt{\in_r}$.

Many portable wireless communication electronic devices include antennas to provide cellular system communication functionality, for example, GSM, or WCDMA communication functionality, and/or antennas to provide non-cellular system communication functionality, for example, Bluetooth, W-LAN, or FM-Radio communication functionality. The number of supported systems directly increases the number of required antennas, which results in a substantial increase in the component part count and, consequently, the size and cost of the electronic devices themselves.

SUMMARY

Embodiments of the present invention is to provide an improved antenna assembly.

An exemplary antenna assembly may include a printed wiring board (PWB) and a dielectric substrate including a first antenna pattern, for example, an antenna radiating element, the dielectric substrate being configured to be mounted on the PWB. The antenna assembly may also include a second antenna pattern that is configured to be used as a radiating element of a frequency modulation transmitter antenna, for example, an FM Tx antenna, or a Near Field Communication (NFC) antenna. The second antenna pattern may be provided a) on/in the dielectric substrate, for example, on a surface of the dielectric substrate or inside the dielectric substrate, or b) on the PWB at the interface between the dielectric substrate and the PWB, or c) partly on a surface of the dielectric substrate and partly on a surface of the PWB.

An FM transmitter, or FM Tx, may include an electronic device which, with the aid of an antenna, propagates an electromagnetic signal such as radio, television, or other telecommunications. In an antenna assembly according to the present invention, an FM Tx antenna may be integrated with another dielectric-loaded antenna inside a wireless device without a corresponding increase in the component part count or size of the device.

Traditionally, an FM Tx antenna has been a separate component that is typically connected to the motherboard of an electronic device via gold-plated pins or springs. Embodiments of the present invention are based on the inventor's insight that since an FM transmitter is a near system, its antenna gain requirement is low, so it is possible to integrate an FM Tx antenna with another antenna included on/in a dielectric substrate. An FM Tx antenna may, therefore, be implemented into a Bluetooth chipset, for example, whereby the Bluetooth and FM Tx antennas are incorporated into the same component(s) of the electronic device, which can result in a more compact device that is incomplex and less expensive to manufacture.

Near Field Communication (NFC) is a short-range high frequency (e.g., radio frequency from 3-30 MHz) wireless communication technology which enables the exchange of data between devices over about a 10 cm distance. Traditionally, NFC antennas have also been separate components that are typically connected to the motherboard of an electronic device via gold-plated pins or springs.

According to an embodiment of the invention, a first antenna pattern is configured to provide non-cellular system communication functionality, such as Bluetooth, GPS, Rx diversity, or W-LAN communication functionality. Because the frequency band within which a second antenna pattern transmits signals when the antenna assembly is in use may differ significantly from the frequency band within which such systems receive and transmit signals, such an antenna assembly may provide good isolation between the first and second antenna patterns.

According to another embodiment of the invention, a dielectric substrate and a first antenna pattern constitute part of a planar inverted F (PIFA) antenna. PIFA antennas may be derived from a quarter-wave half-patch antenna, for example. The shorting plane of the half-patch may be reduced in length to thereby decrease the resonance frequency. PIFA antennas may have multiple branches to resonate at various cellular bands. Alternatively, the dielectric substrate and the first antenna pattern may constitute part of a dielectric resonator (DRA) antenna.

A dielectric substrate for use in an antenna assembly may be provided according to any of the embodiments of the invention. The dielectric substrate may include a first antenna pattern and at least part of a second antenna pattern. According to an embodiment of the invention, the dielectric substrate may include a material having a high magnetic permeability (μ), such as ferrite.

Embodiments of the present invention may include a printed wiring board (PWB) that includes such a dielectric substrate. Alternatively or additionally, embodiments of the present invention may include a PWB that includes at least part of a second antenna pattern.

The expression, printed wiring board, or PWB (also called printed circuit board (PCB)), as used herein, may include any flexible or non-flexible, planar or non-planar, substantially non-electrically-conductive substrate that is used to mechanically support at least one microchip or other electronic component, and/or to electrically connect components supported thereon and/or connected thereto using conductive pathways etched/printed/engraved or otherwise provided thereon.

According to an embodiment of the present invention, a dielectric substrate of an antenna assembly according to any of the embodiments of the invention may be mounted along an edge, or in a corner of a printed wiring board according to any of the embodiments of the invention. Positioning a dielectric substrate of an antenna assembly in a corner of the PWB facilitates the manufacture and assembly of an antenna. An antenna assembly may, however, be located at any position on a PWB.

According to an embodiment of the present invention, the PWB according to any of the embodiments of the invention may include a ground plane and circuitry to connect the ground plane to the second antenna assembly, the circuitry including a capacitive and/or inductive coupling, for example, an LC load, to enable the second antenna pattern to transmit signals within a particular frequency band when the antenna assembly is in use.

According to an embodiment of the present invention, the dielectric substrate of the antenna assembly may be integrally formed with the PWB, whereby the manufacture of a complete PWB including an antenna assembly may be integrated into substantially one manufacturing step, thereby reducing the assembly time, costs and complexity.

The present invention may provide a device, such as a portable electronic device, which includes an antenna assembly and/or a dielectric substrate and/or a PWB according to any of the embodiments of the invention. The electronic device may be a portable or non-portable device, such as a telephone, media player, Personal Communications System (PCS) terminal, Personal Data Assistant (PDA), laptop computer, palmtop receiver, camera, television, radar or any appliance that includes a transducer (e.g., transceiver) configured to transmit and/or receive radio, television, microwave, telephone and/or radar signals. The antenna assembly, dielectric substrate, and PCB according to the present invention may, however, be intended for use particularly, but not exclusively, for high frequency radio equipment.

It will be appreciated that when the antenna assembly according to any of the embodiments of the invention is included in a small portable radio communication device, such as a mobile phone, it may partially contribute to the transmission or reception of the radio waves transmitted or received by the device. Other large, electrically conductive components of the device, such as its chassis, its battery, or PWB may also influence the transmission and/or reception of radio signals. The antenna patterns of the antenna assembly may be capacitively and/or inductively coupled to the mass blocks in such a way that the complete antennas (i.e. the antenna assemblies and the mass blocks) are provided with the desired impedance. Consequently, a component that is normally considered to be an "antenna," in fact, may function as an exciter for such mass blocks and may have, therefore, been designated an "antenna assembly" rather than an "antenna." The expression, "antenna," as used herein, may include components that may be considered to be "antenna assemblies" rather than "antennas."

BRIEF DESCRIPTION OF THE DRAWINGS

The present invention will hereinafter be further explained by means of non-limiting examples with reference to the appended figures.

It should be noted that the drawings have not been drawn to scale and that the dimensions of certain features have been exaggerated for the sake of clarity.

DETAILED DESCRIPTION OF EMBODIMENTS

Figure 1:
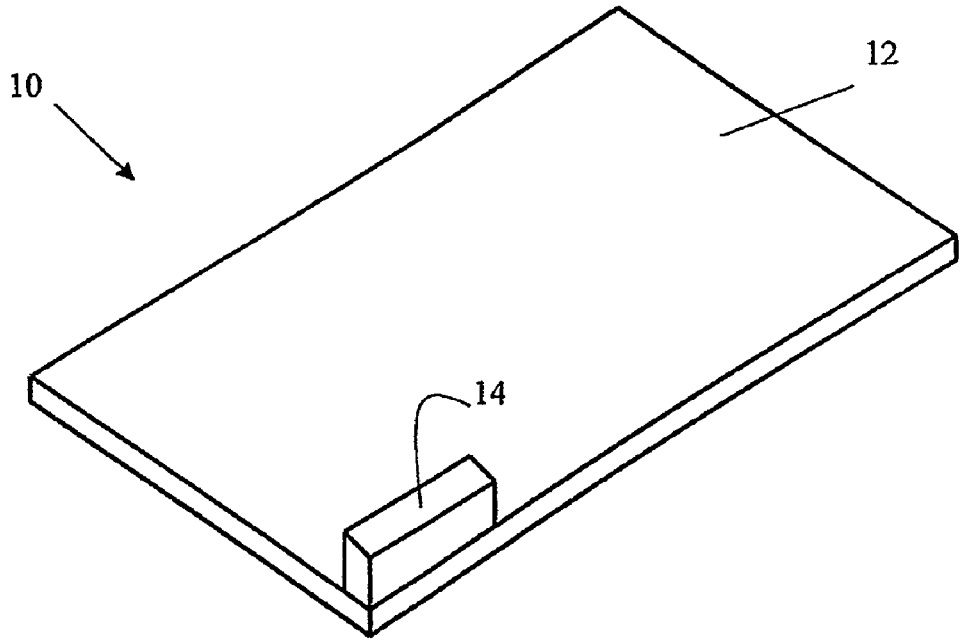
FIG. 1 shows an antenna assembly according to an embodiment of the invention.

FIG. 1 shows an antenna assembly 10 including a printed wiring board (PWB) 12 and a dielectric substrate 14, such as a ceramic substrate, including a first antenna pattern (not shown in FIG. 1) and located in a corner of PWB 12. The first antenna pattern may be configured, for example, to provide non-cellular system communication functionality, such as Bluetooth, GPS, Rx diversity or W-LAN communication functionality.

Dielectric substrate 14 may be of single- or multi-layer construction and have a relative dielectric constant (∈r) greater than one (i.e., >1) and may include, for example, a PTFR (polytetrafluoroethylene)/fiberglass composite or any other suitable dielectric material having a relative dielectric constant (∈r) greater than one and up to twenty or more. According to an embodiment of the invention, the dielectric substrate may include a material having a high magnetic permeability (□).

Dielectric substrate 14 may include a second antenna pattern (not shown in FIG. 1) that may be configured to be used as a radiating element of an FM Tx antenna or an NFC antenna. The second antenna pattern may be provided on any surface of dielectric substrate 14 or inside dielectric substrate 14. The second antenna pattern may be provided on PWB 12 at the interface between dielectric substrate 14 and PWB 12. The second antenna pattern may be provided partially on a surface of dielectric substrate 14 and partially on the surface of PWB 12. The first and second antenna patterns may be provided on/inside dielectric substrate 14 using a lithographic technique, for example.

Dielectric substrate 14, in the illustrated embodiment, is shown as a rectangular block. It should be noted, however, that dielectric substrate 14 may be of any shape and may have any number of branches. Dielectric substrate 14 or a branch of a dielectric substrate 14 may, for example, be square, circular, triangular or elliptical cross section or have any other regular or irregular geometric form. Dielectric substrate 14 could have, for example, a cylindrical form on which a helical antenna pattern is deposited.

PWB 12 and dielectric substrate 14 may be integrally formed as a single unit. Alternatively, dielectric substrate 14 may be mounted on PWB 12 by any conventional means, such as soldering or spot welding.

Figure 2:
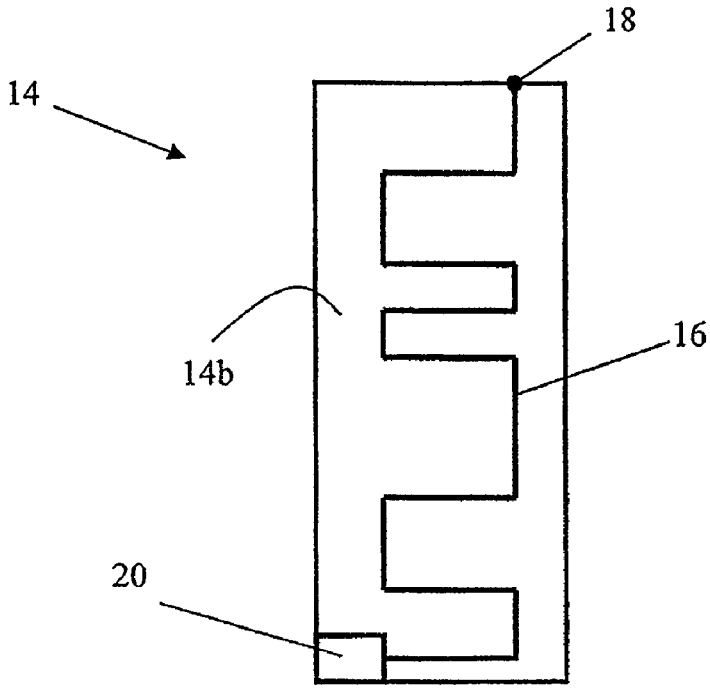
FIG. 2 is a schematic view of a bottom surface of a dielectric block according to an embodiment of the invention.

FIG. 2 shows a bottom surface 14*b* of dielectric substrate 14. Dielectric substrate 14 may include a first antenna pattern (not shown in FIG. 2) on a top surface of dielectric substrate 14 or inside dielectric substrate 14. A second antenna pattern 16 that may be configured to be used as a radiating element of an FM Tx antenna and/or an NFC antenna may be provided on bottom surface 14*b* of dielectric substrate 14.

Dielectric substrate 14 in the illustrated embodiment may include a feed point 18 for connecting the second antenna pattern 16 to a feed line (e.g., a medium for conveying signal energy from a signal source to the antenna pattern) and a ground point and circuitry 20 for connecting second antenna pattern 16 to ground via a capacitive and/or inductive coupling, for example, an LC load, to enable second antenna pattern 16 to operate at a particular resonant frequency and consequently transmit signals within a particular frequency band when the antenna assembly is in use.

Figure 3:
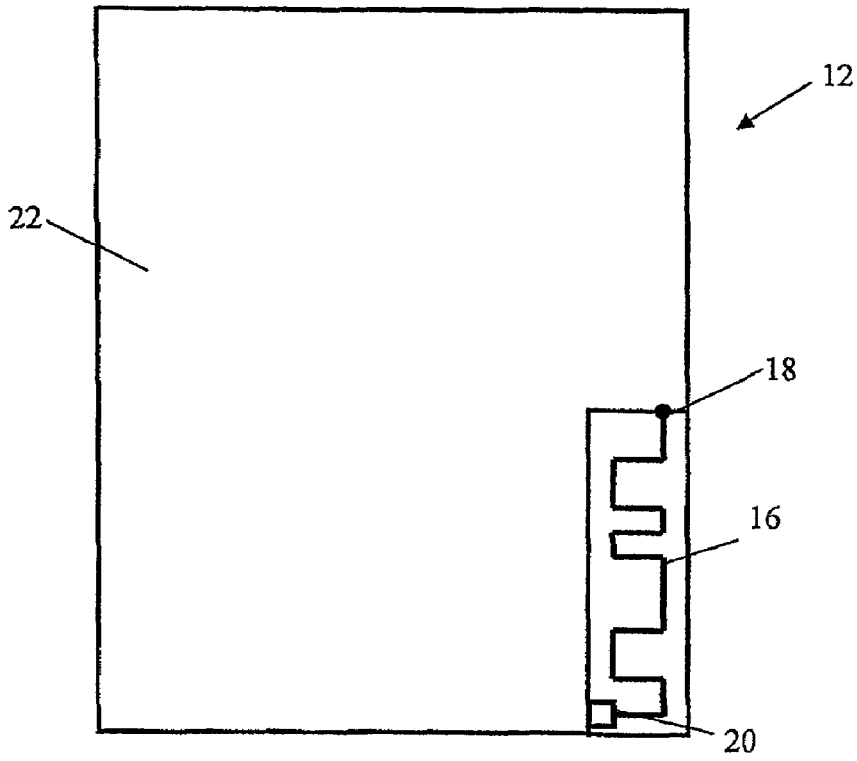
FIG. 3 shows the top surface of a printed circuit board according to an embodiment of the invention.

FIG. 3 shows a top surface of PWB 12 according to an embodiment of the invention. PWB 12 may include a ground plane 22 and second antenna pattern 16 that may be configured to be used as a radiating element of an FM Tx antenna or an NFC antenna that is provided on part of the surface of PWB 12 from which ground plane 22 has been removed or omitted. Dielectric substrate 14 including another antenna pattern may be mounted on top of second antenna pattern 16 that may be configured to be used as a radiating element of an FM Tx antenna or an NFC antenna.

According to an embodiment of the invention, a first portion of second antenna pattern 16*a* that may be configured to be used as a radiating element of an FM Tx antenna or NFC antenna may be provided on bottom surface 14*b* of dielectric substrate 14 and a second part of second antenna pattern 16*b* that may be configured to be used as a radiating element of an FM Tx antenna or NFC antenna may be provided on the top surface of PWB 12, whereby second antenna pattern 16 may be completely formed when dielectric substrate 14 is mounted on PWB 12.

Figure 4:
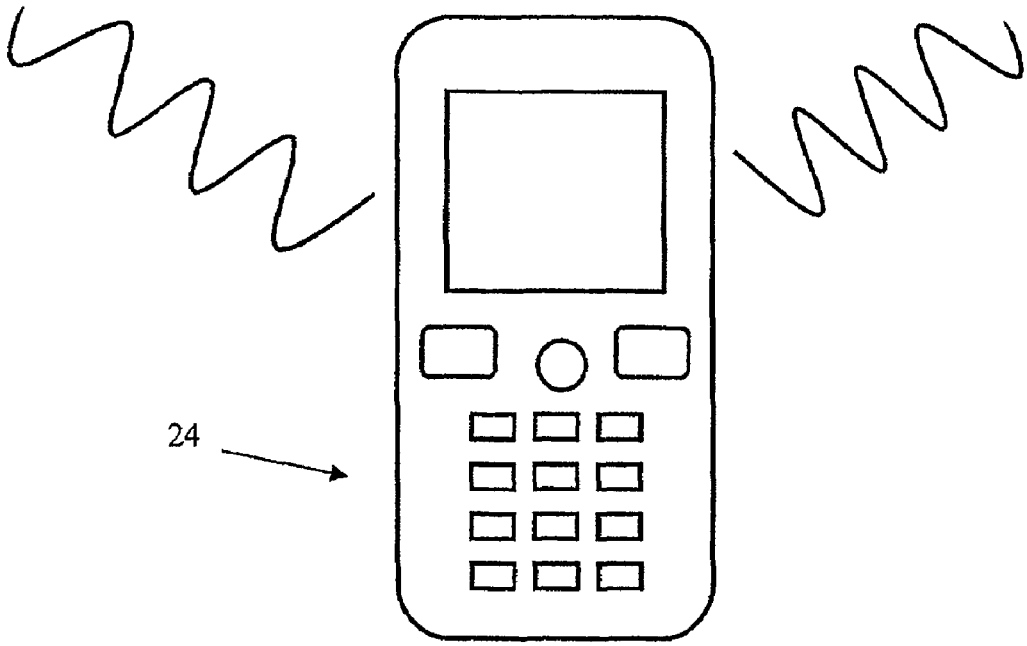
FIG. 4 shows an electronic device according to an embodiment of the invention.

FIG. 4 shows an electronic device 24, for example, a mobile telephone, according to an embodiment of the invention. Electronic device 24 may include antenna assembly 10 or PWB 12 or a dielectric substrate (not shown in FIG. 4) according to any of the embodiments of the invention.

Further modifications of the invention within the scope of the claims would be apparent to a skilled person. For example, a PWB may include circuitry to enable a user to switch between different antenna assemblies or between different antenna patterns of an antenna assembly and thereby select the frequency band of transmitted and/or received signals and the number of communication channels in use.

What is claimed is:

1. An antenna assembly comprising:

a printed wiring board (PWB);

a dielectric substrate including a first antenna pattern, the dielectric substrate being configured to mount to the PWB; and a second antenna pattern configured to be used as a radiating element of an FM Tx antenna or a near field communication (NFC) antenna, wherein, before the dielectric substrate is mounted to the PWB, a first portion of the second antenna pattern is disposed on or in the dielectric substrate and a second portion of the second antenna pattern is disposed on the PWB at an interface of the dielectric substrate and the PWB, wherein the second antenna pattern is formed from the mounting of the dielectric substrate to the PWB.

2. The antenna assembly of claim 1, wherein the first antenna pattern is further configured to provide non-cellular system communication functionality.

3. The antenna assembly of claim 2, wherein the non-cellular system communication functionality comprises Bluetooth, GPS, Rx diversity, or W-LAN communication functionality.

4. The antenna assembly of claim 1, wherein the second antenna pattern is disposed on the dielectric substrate.

5. The antenna assembly of claim 1, wherein the second antenna pattern is disposed in the dielectric substrate.

6. The antenna assembly of claim 1, wherein the second antenna pattern is disposed on the PWB at an interface of the dielectric substrate and the PWB.

7. The antenna assembly of claim 1, wherein the second antenna pattern is disposed partially on surfaces of both the dielectric substrate and the PWB.

8. The antenna assembly of claim 1, wherein the dielectric substrate and the first antenna pattern comprise a planar inverted F antenna.

9. The antenna assembly of claim 1, wherein the dielectric substrate and the first antenna pattern comprise a dielectric resonator antenna.

10. The antenna assembly of claim 1, wherein the dielectric substrate comprises at least a portion of the second antenna pattern.

11. A printed wiring board (PWB) comprising:

a dielectric substrate mounted to the PWB, wherein the dielectric substrate includes a first antenna pattern and the PWB includes a first portion of a second antenna pattern; and the second antenna pattern, configured to be used as a radiating element of an FM Tx antenna or a near field communication (NFC) antenna, wherein a second portion of the second antenna pattern is disposed on or in the dielectric substrate, the first portion of the second antenna pattern is disposed on the PWB at an interface of the dielectric substrate and the PWB, and formation of second antenna is completed by the interface of the dielectric substrate and the PWB.

12. The PWB of claim 11, further comprising:

a ground plane; and circuitry to connect the ground plane to the second antenna assembly, the circuitry including at least one of capacitive coupling or inductive coupling to enable the second antenna pattern to operatively transmit signals within a predetermined frequency band.

13. The PWB of claim 11, wherein the second antenna pattern is disposed on the dielectric substrate.

14. The PWB of claim 11, wherein the second antenna pattern is disposed in the dielectric substrate.

15. The PWB of claim 11, wherein the second antenna pattern is disposed on the PWB at an interface of the dielectric substrate and the PWB.

16. A communication device comprising:

an antenna assembly including:

a printed wiring board (PWB), a dielectric substrate including a first antenna pattern, the dielectric substrate being configured to mount to the PWB, and a second antenna pattern configured to be used as a radiating element of an FM Tx antenna or a near field communication (NFC) antenna, wherein, before the dielectric substrate is mounted to the PWB, a first portion of the second antenna pattern is disposed on or in the dielectric substrate and a second portion of the second antenna pattern is disposed on the PWB at an interface of the dielectric substrate and the PWB, wherein the second antenna pattern is formed from the mounting of the dielectric substrate to the PWB.

17. The communication device of claim 16, wherein the second antenna pattern is disposed on the dielectric substrate.

18. The communication device of claim 16, wherein the second antenna pattern is disposed in the dielectric substrate.

19. The communication device of claim 16, wherein the second antenna pattern is disposed on the PWB at an interface of the dielectric substrate and the PWB.

* * * * *